US005462516A

United States Patent [19]

Anderson

[11] Patent Number: 5,462,516

[45] Date of Patent: Oct. 31, 1995

[54] CYCLICAL ACTION MASSAGING CHAIR

[75] Inventor: Louis R. Anderson, Waxhaw, N.C.

[73] Assignee: Niagara Therapy Manufacturing, Inc., Stanley, N.C.

[21] Appl. No.: 174,840

[22] Filed: Dec. 29, 1993

[51] Int. Cl.[6] ..... A61H 15/00

[52] U.S. Cl. ..... 601/99; 601/116; 601/112

[58] Field of Search ..... 601/51, 52, 90, 601/91, 93, 94, 97, 98, 99, 100, 101, 102, 103–116, 122, 126, 127, 128

[56] References Cited

U.S. PATENT DOCUMENTS

| | | | |
|---|---|---|---|
| 2,827,044 | 3/1958 | Orthwine . | |
| 3,322,116 | 5/1967 | Murphy et al. . | |
| 3,389,699 | 6/1968 | Mathers . | |
| 3,405,709 | 10/1968 | Mathers . | |
| 3,633,571 | 1/1972 | Shinagawa et al. . | |
| 3,736,920 | 6/1973 | Mathers et al. . | |
| 3,841,321 | 10/1974 | Albach et al. . | |
| 3,882,856 | 5/1975 | Heuser | 601/116 |
| 3,939,826 | 2/1976 | Fujimoto . | |
| 4,009,710 | 3/1977 | Inada . | |
| 4,079,732 | 3/1978 | Shinichiro . | |
| 4,149,531 | 4/1979 | Tanaka et al. . | |
| 4,422,448 | 12/1983 | Sugai et al. . | |
| 4,422,449 | 12/1983 | Hamabe . | |
| 4,454,867 | 6/1984 | Swanson . | |
| 4,574,786 | 3/1986 | Hashimoto et al. . | |
| 4,615,336 | 10/1986 | Fijimoto . | |
| 4,686,967 | 8/1987 | Hashimoto | 601/116 |
| 4,718,408 | 1/1988 | Barreiro . | |
| 4,915,448 | 4/1990 | Morgenstern . | |
| 5,020,518 | 6/1991 | Spears et al. . | |
| 5,086,769 | 2/1992 | Vianello et al. . | |
| 5,137,016 | 8/1992 | Yamasaki | 601/116 |
| 5,165,129 | 11/1992 | Rohm . | |
| 5,184,607 | 2/1993 | Hwang | 601/102 |

FOREIGN PATENT DOCUMENTS

| | | | |
|---|---|---|---|
| 403286768 | 12/1991 | Japan | 601/94 |

*Primary Examiner*—Robert A. Hafer
*Assistant Examiner*—David J. Kenealy
*Attorney, Agent, or Firm*—Bell, Seltzer, Park & Gibson

[57] ABSTRACT

A massaging chair according to the present invention provides an efficient and comfortable massage to a person sitting therein. The massaging chair preferably has a seat for supporting the lower torso of a user thereon and a back for supporting the back of a user thereon. The back includes a flexible front surface which is adapted to directly contact the back of the user. The massaging chair also has a massaging carriage mounted within the back of the chair, a transverse rod rotatably mounted to the carriage and so as to define a generally horizontal rod axis which extends generally parallel to the flexible front surface of the back of the chair, at least one roller assembly mounted to the rod and including a plurality of separate rollers which are mounted for free rotation about parallel axes which are radially spaced from and parallel to the rod axis. The rollers are positioned so as to sequentially contact the flexible front surface of the back upon rotation of the rod, and thereby massage the back of the user supported in the chair.

18 Claims, 4 Drawing Sheets

CYCLICAL ACTION MASSAGING CHAIR

FIELD OF INVENTION

The invention relates to chairs and, more particularly, to chairs for massaging the back of person sitting therein.

BACKGROUND OF THE INVENTION

Numerous beneficial effects upon the human body of various physical forces and motions such as vibration and massage have long been recognized. Accordingly, there have been a variety of devices and machines, both manual and automatic, i.e., electrical or motor driven, for applying physical forces to the body. Some of the most known automatic massaging devices take the form of a table or chair. The user rests comfortably on the table or chair while receiving the beneficial massaging treatment, often to the back or the legs. The massaging chairs are particularly appealing to users desiring the massage because one can either use the chair as an ordinary piece of furniture or else passively sit in it and utilize its massaging actions.

These massaging chairs conventionally have used a vibration mechanism such as rollers positioned within the back of the chair to provide a vibratory massaging action to the user. The vibration mechanism may be stationary or may vertically travel up and down the back of the chair. Examples of such chairs may be seen in U.S. Pat. No. 3,322,116 by Murphy et al. entitled "*Vibratory Massage Apparatus*" and U.S. Pat. No. 2,827,044 by Orthwine entitled "*Portable Massaging Apparatus.*" These vibration mechanisms by themselves, however, usually provide little physical force against the back of the user and, therefore, provide little muscular massage.

Other massaging chairs have recently used back-pressure type rollers which vertically travel up and down the back of the chair and contact a flexible front surface of the back which, in turn, contacts the back of the user. These back-pressure type rollers have attempted to provide a stronger muscular massage to the back of the user. Examples of such chairs may be seen in U.S. Pat. No. 5,137,016 by Yamasaki et al. entitled "*Automatic Multifunction Massager For Chair*", U.S. Pat. No. 4,615,336 by Fijimoto entitled "*Automatic Massaging Machine*", U.S. Pat. No. 4,574,786 by Hashimoto et al. entitled "*Massage Apparatus*", and U.S. Pat. No. 4,718,408 by Barreiro entitled "*Variable Massage Apparatus Having A Clutch Selectively Engaging Alternate Gears.*" Although these back-pressure type roller mechanisms have experienced some success in the industry, these mechanisms have provided little or no kneading of the back muscles which has many beneficial effects to the user.

Massaging chairs having a kneading-type mechanism therein have recently been developed for providing the beneficial effects of kneading the back muscles of the user. Examples of these kneading-type mechanisms may be seen in U.S. Pat. No. 5,020,518 by Spears et al. entitled "*Travelling Roller Massage Apparatus*" and U.S. Pat. No. 4,454,867 by Swanson entitled "*Therapeutic Chair Assembly.*" These kneading-type mechanisms often provide a kneading roller which reciprocates up and down the back of the chair, but often in a non-uniform pattern. Other kneading-type mechanisms provide a kneading-type pressure on the user's back, but little or no concentrated and strong kneading-type pressure.

SUMMARY OF THE INVENTION

It is an object of the present invention to provide a massaging chair that efficiently and comfortably massages the back of a person sitting therein. The massaging chair provides the beneficial treatment of a concentrated, controlled, and strong kneading-type massage to a person while also providing the beneficial effects of the vibratory and the back-pressure type roller massages.

More particularly, the massaging chair preferably has a seat for supporting the lower torso of a user thereon and a back for supporting the back of a user thereon. The back preferably includes a flexible front surface which is adapted to directly contact the back of the user. The massaging chair also has a massaging carriage mounted within the back of the chair. A transverse rod is rotatably mounted to the carriage and so as to define a generally horizontal rod axis which extends generally parallel to the flexible front surface of the back of the chair. At least one roller assembly is mounted to the rod and includes a plurality of separate rollers which are mounted for free rotation about parallel axes which are radially spaced from and parallel to the rod axis. The rollers are positioned so as to sequentially contact the flexible front surface of the back of the chair upon rotation of the rod. First drive means the rod rotates about its axis so that the rollers sequentially contact the flexible front surface of the back of the chair and thereby massage the back of the user supported in the chair.

In order to provide a more continuous and controlled movement of the massaging carriage, the massaging carriage is preferably mounted to an elongate shaft positioned within the back of the chair so as to extend along a substantial portion of the height dimension of the back of the chair. Second drive means is connected to the shaft for rotating the shaft about its axis. Thread means is mounted to the shaft and interconnects the shaft and the massaging carriage so as to transport the massaging carriage along the length of the shaft upon rotation thereof. The thread means preferably includes an endless thread groove extending along the length of the shaft and a follower mounted to the massaging carriage to engage the groove so that the carriage reciprocates along the shaft upon such rotation of the shaft.

DETAILED DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF ILLUSTRATED EMBODIMENTS

The present invention now will be described more fully hereinafter with reference to the accompanying drawings in which illustrated embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
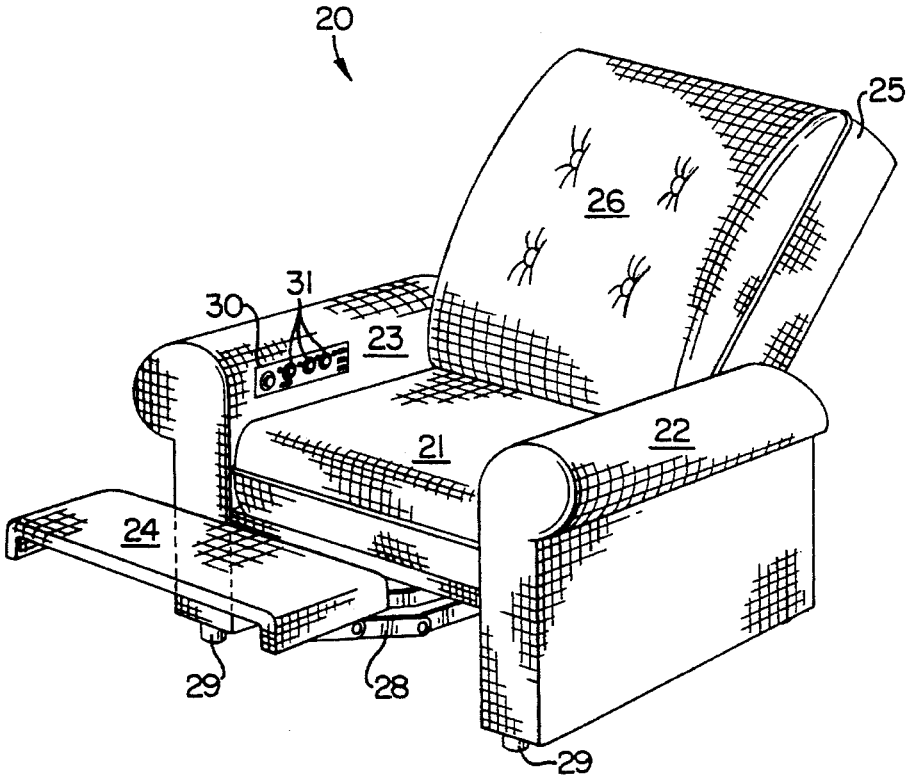
FIG. 1 is a side perspective view of an embodiment of a massaging chair according to the present invention illustrated in the form of a recliner.
Figure 2:
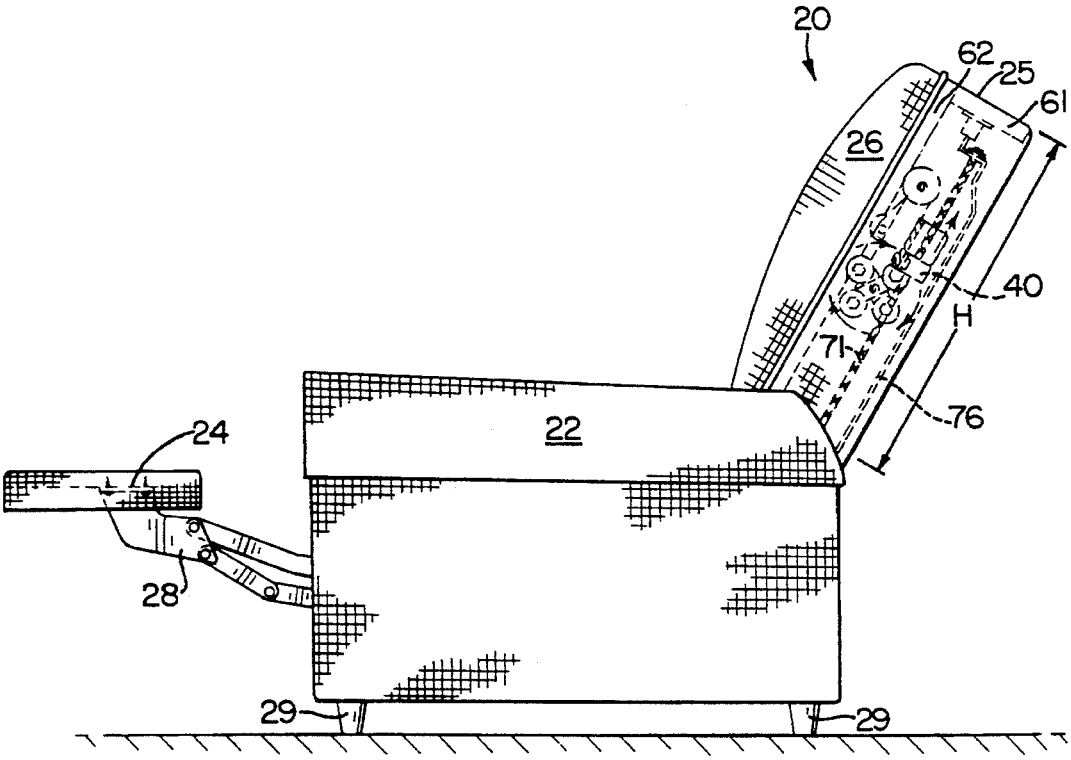
FIG. 2 is a side elevational view of a massaging chair shown in the form of a recliner according to the present invention and illustrating the cyclical massaging action of a massaging apparatus according to the present invention.

FIGS. 1 and 2 illustrate an embodiment of a massaging chair 20 in the form of a recliner according to the present invention. The massaging chair 20 of the present invention provides an efficient and comfortable massage to a person sitting therein. The massaging chair 20 has a seat 21 for supporting the lower torso of a user thereon and a back 25 for supporting the back of a user thereon. A pair of arms 22, 23 preferably connects to and extends from side portions of the back 25 and the seat 21 toward a support surface such as the floor illustrated in FIG. 2. The chair 20 is also preferably supported by four feet which are spaced-apart and positioned at respective lower end corner portions of the chair 20. A foot rest 24 of the chair 20 pivots from a position relatively perpendicular to the seat 21 and adjacent a forward portion of the seat 21 to an extended position thereof by use of a foot rest extension member 28 well known to those skilled in the art.

Figure 3:
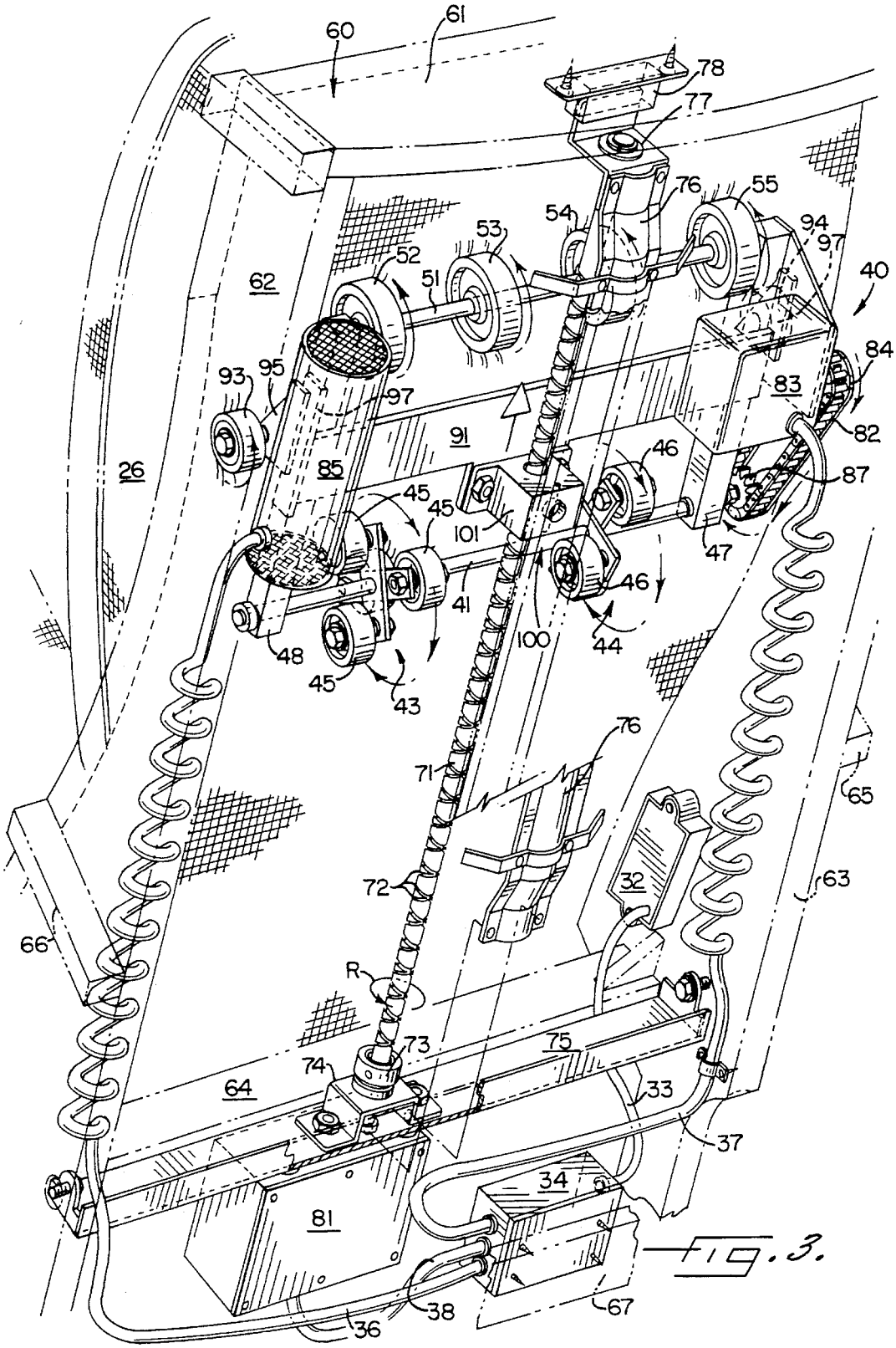
FIG. 3 is a rear perspective view of a massaging apparatus positioned in the back of a massaging chair according to the present invention.

As best illustrated in FIGS. 2 and 3, the back 25 of the chair 20 includes a flexible front surface 26 which is adapted to directly contact the back of the user and provides a massage surface for the massaging apparatus according to the present invention. Although the preferred embodiment of the present invention has a massaging apparatus positioned within the back of the massaging chair 20 as described herein, it will be apparent that a massaging apparatus according to the present invention may also be used for other massaging devices such as massaging beds, massaging sofas, or the like. The massaging apparatus includes a massaging carriage 40 mounts within the back 25 of the chair 20 for reciprocal movement along a path of travel corresponding to the height direction H of the back 25. An elongate shaft 71 preferably longitudinally extends the substantial height H of the back 25 and is mounted to a rectangular-shaped back frame member 60 which provides structural support for the back 25 of the chair 20 and a support structure for mounting the shaft 71. The shaft 71 is also preferably centrally mounted along the transverse width W (see FIG. 4) of the back 25 of the chair 20. The back frame member 60 includes upper and lower end frame members 61, 64 and side frame members 62, 63 extending relatively perpendicular therebetween. Arm frame members 65, 66 connect to and cooperate with the side frame members 62, 63 as illustrated. A lower end of the shaft 71 connects to a lower bracket 74 through a collar member 73 connected thereto. The lower bracket 74 preferably connects to a shaft support member 75 which transversely extends between and is connected to the side frame members 62, 63. An elongate shaft channel member 76 also preferably connects to the lower bracket 74 and an upper bracket 77. The upper bracket 77 preferably connects to the upper end frame member 61 by a bracket mating member 78 cooperating with the upper bracket 77 as illustrated. The shaft channel member 76 also longitudinally extends the substantial height H of the back 25 to thereby provide a protective channel for the reciprocal travel of the carriage 40 up and down the shaft 71.

Figure 4:
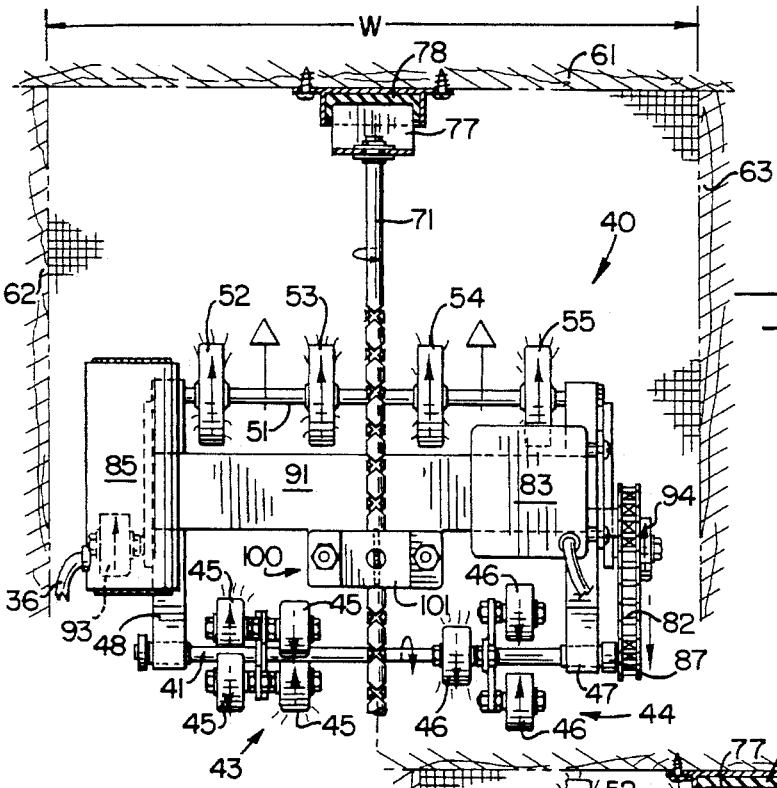
FIG. 4 is a partial rear elevational view of a massaging apparatus positioned in the back of a massaging chair according to the present invention.
Figure 5:
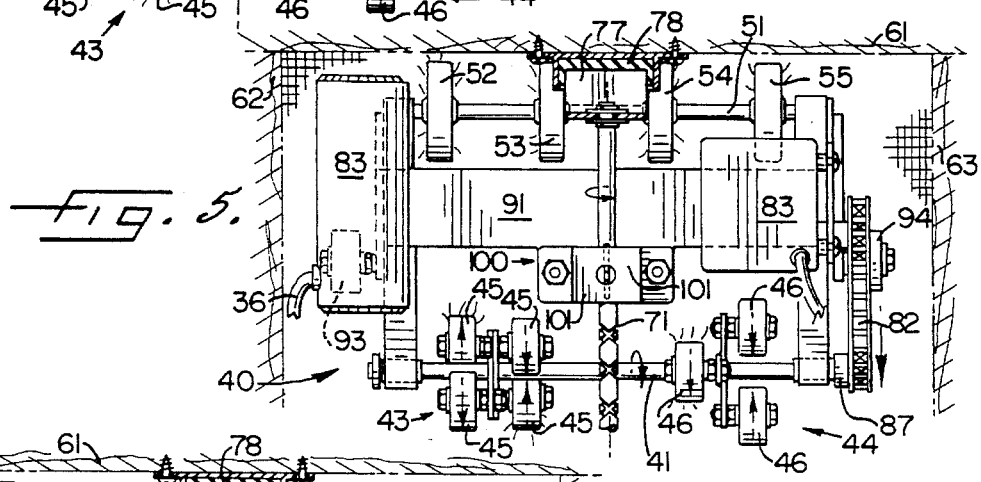
FIG. 5 is a partial rear elevational view of a massaging apparatus positioned in the back of a massaging chair according to the present invention.
Figure 6:
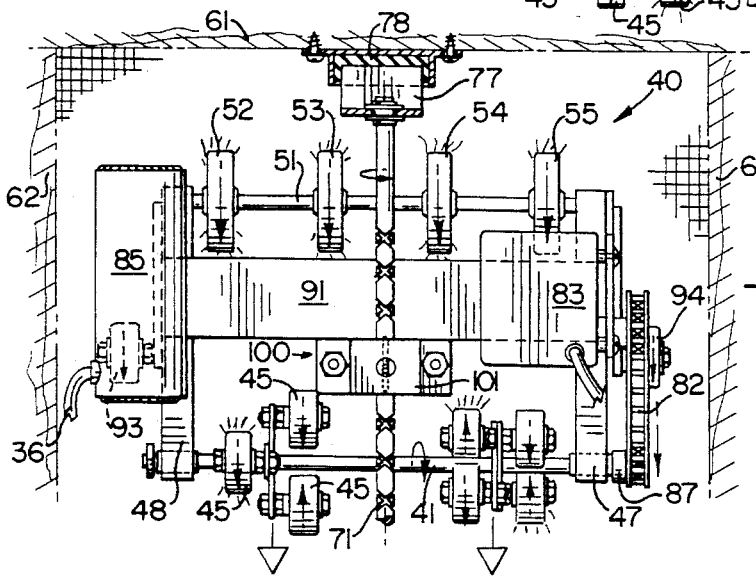
FIG. 6 is a partial rear elevational view of a massaging apparatus positioned in the back of a massaging chair according to the present invention.

A first drive motor 81, preferably mounted within a housing, is mounted to the shaft support member 75, and also is operationally connected to the shaft 71. The first motor 81 preferably includes a motor drive shaft longitudinally extending therefrom and rotates the shaft 71 about its axis to thereby reciprocate the carriage 40 along the path of travel up and down the back 25. The first motor 81 preferably continuously rotates the shaft 71 in only one direction as indicated by the arrow R. An endless thread groove 72 extends along the substantial length of the shaft 71 as illustrated. A follower 110 mounts to the carriage 40 and engages the groove 72. The groove 72 and the follower 110 thereby interconnect the shaft 71 and the carriage 40 so as to transport the carriage 40 along the length of the shaft 71 upon rotation thereof (as best shown in FIGS. 4–6).

A first transverse and elongate rod 41 rotatably mounts to the carriage 40 so as to define a generally horizontal first rod axis which extends generally parallel to the flexible front surface 26 of the back 25 of the chair 20. At least one roller assembly, and preferably a pair of roller assemblies 43, 44 as illustrated in FIGS. 3–6, mounts to the first rod 41 and includes a plurality of separate rollers 45, 46 which are mounted for free rotation about parallel axes. The rollers 45, 46 are also preferably radially spaced from and parallel to the first rod axis. Each roller assembly 43, 44 of this illustrated embodiment preferably has four rollers 45, 46 respectively. The rollers 45, 46 are positioned at spaced-apart 90 degree angles about the axis of the first rod 41 by overlapping plate members having rollers 45, 46 connected thereto by various nuts and bolts as illustrated. As best illustrated in FIGS. 2 and 3, the rollers 45, 46 are positioned so as to sequentially contact the flexible front surface 26 of the back 25 upon rotation of the first rod 41. The rotating rollers 45, 46 thereby provide a cyclical kneading-type massaging action to the user of the chair 20 and provide a strong and concentrated massage to selected areas of the user's back.

A second drive motor 83 preferably mounts to the carriage 40 to thereby rotate the first transverse rod 41 about its axis so that the rollers 45, 46 sequentially contact the flexible front surface of the back 25 of the chair 20. The sequential contact with the back 25 preferably occurs while the carriage 40 reciprocates along a path of travel up and down the elongate shaft 71 to thereby massage the back of the user supported in the chair 20. Also, a massaging carriage controller, including a control panel 30 which preferably mounts to an arm 23 of the chair 20 and electrically communicates with the first and second drive motors 81, 83 (as best shown in FIG. 3), controls the longitudinal position of the massaging carriage 40 and the rotation of the first rod 41 thereof.

A second transverse elongate rod 51 also preferably mounts to the carriage 40 in a common plane generally parallel with the first rod 41. The second transverse rod 51 and the first transverse rod 41 interconnect by generally parallel side carriage members 47, 48. The side carriage members 47, 48 are preferably longitudinally extending rectangular-shaped rods that lay in a common plane with the elongate shaft 71. The first and second transverse rods 41, 51 mount to respective opposing end portions of the side carriage members 47, 48 and are thereby spaced-apart the substantial length of the side carriage members 47, 48. The second transverse rod 51 also reciprocally travels the substantial longitudinal extent of the shaft 71 in a corresponding relationship to the reciprocal travel of the carriage 40. The second rod 51 has a plurality of rollers 52, 53, 54, 55, and preferably four rollers as illustrated, mounted thereto. As best illustrated in FIG. 3, the rollers 52–55 of the second rod 51 preferably have a larger diameter than the rollers 45, 46 mounted to the first rod 41. The rollers 52–55 are also preferably spaced apart along the second rod 51 to provide an even and continuous vibrator and pressure type massage.

The carriage 40 as illustrated is also preferably supported solely by the shaft 71 and the plurality of rollers 52, 53, 54, 55 mounted to the second transverse rod 51 are positioned in abutting contact with the flexible front surface 26 of the back 25 of the chair 20. An elongate plate member 91 also mounts to and transversely extends between the side carriage members 47, 48. The plate member 91 is preferably positioned between the first and second transverse rods 41, 51 of the carriage 40. A pair of angle plate members 95, 97 further connects to each of the side carriage members 47, 48 along opposing ends of the plate member 91. A roller 93, 94 mounts to each angle plate member 95, 97 as illustrated and also abuttingly contacts the flexible front surface 26 of the back 25 of the chair 20. The rollers 93, 94 of the elongate plate member 91 further provide both a smooth guiding movement for the carriage 40 as it travels up and down the back of the chair as well as back-pressure type massage to the back of the user.

The massaging chair 20 further has a vibration motor 85 mounted to the carriage 40 for vibration of the rollers 45, 46, 52–55, 93, 94 connected thereto during the reciprocal travel of the carriage 40. The vibration motor 85 and the second drive motor 83 preferably mount to the side carriage members 47, 48 as illustrated. The second drive motor 83 is also preferably mounted in a housing connected to side carriage member 47 and has a drive shaft 84 extending therefrom. A drive chain 82 connects to and extends between the drive shaft 84 and a sprocket member 87 mounted to the first transverse rod 41 to thereby rotationally drive the first rod 41 about its axis by operation of the second drive motor 83.

The controller of the chair 20 preferably includes a control panel 30 having various control knobs 31 which control the various massaging functions, i.e., kneading-type cyclical action massage, pressure-type massage, or vibration-type massage, of the chair 20. The controller 30 further includes a switch 32 and control circuitry 34 positioned within a housing and connected to the switch 32 by a wire 33. The control circuitry 34, in turn, connects to the first drive motor 81 via a wire 38, the second drive motor 83 via a wire 37, and the vibration motor 85 via wire 36. The wires 36, 37 respectively connected to the vibration motor 85 and the second drive motor 83 have a substantial length and are generally coiled as illustrated to thereby enable the carriage 40 to easily and reciprocally move within the back 25 of the chair 20.

As illustrated in FIGS. 4–6, the massaging carriage 40 includes cyclical action kneading-type massage functions, continuous back-pressure type massage functions, and vibration type massage functions. By use of the control panel 30, the user can thereby move the massaging carriage 40 up and down the back 25 of the chair 20 and pause the carriage 40 in a particular location for use of the various massaging functions thereof. FIG. 4 illustrates an upward movement of the massaging carriage 40 toward an upper end of the shaft 79 as indicated by the directional arrows. The various rollers 45, 46, 52–55, 93, 94 preferably rotate during this movement as illustrated by the roller arrows. FIG. 5 illustrates the massaging carriage 40 reaching the upward end of the shaft 71 and the groove 72 thereof. FIG. 6, in turn, illustrates the downward movement of the massaging carriage 40 as directed by the directional arrows and the rotation of the rollers 45, 46, 52–55, 93, 94. FIGS. 4–6 also particularly illustrate that the shaft 71 continuously rotates in only one direction so that when the carriage 40 reaches the upward end of the shaft 71, the carriage 40 begins an uninterrupted downward movement or descent down the shaft 71.

Figure 7:
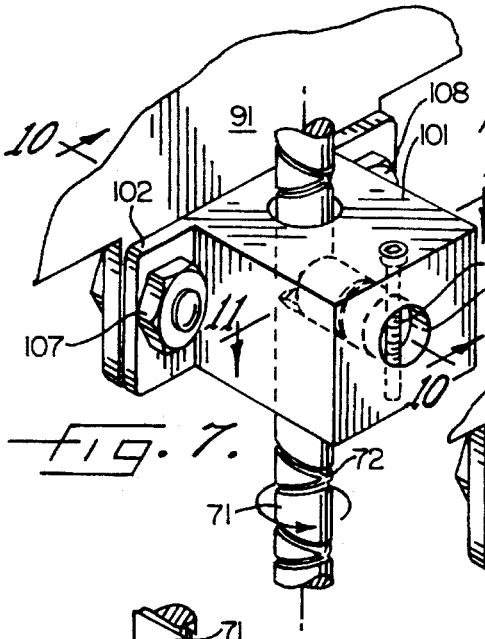
FIG. 7 is an enlarged fragmentary perspective view of a drive shaft and a follower of a massaging apparatus according to the present invention with parts broken away for clarity.
Figure 9:
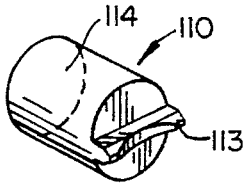
FIG. 9 is a perspective view of a follower of a massaging apparatus according to the present invention.
Figure 10:
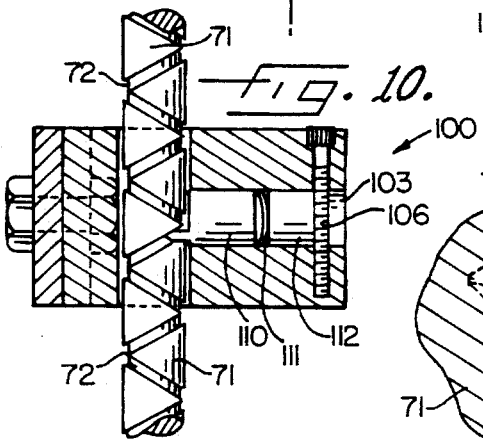
FIG. 10 is a side cross-sectional view of a drive shaft and a follower of a massaging apparatus according to the present invention taken along line 10—10 of FIG. 7.
Figure 12:
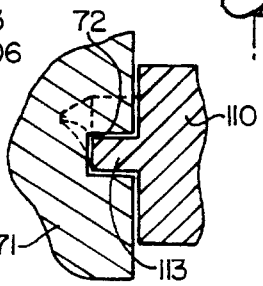
FIG. 12 is a fragmentary cross-sectional view of a follower engaging a drive shaft of a massaging apparatus according to the present invention with parts broken away for clarity.
Figure 13:
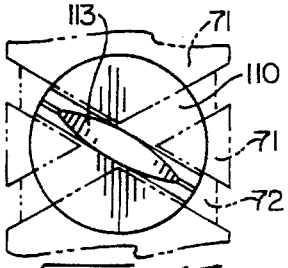
FIG. 13 is a fragmentary view of a follower engaging a drive shaft of a massaging apparatus according to the present invention with parts broken away for clarity.
Figure 11:
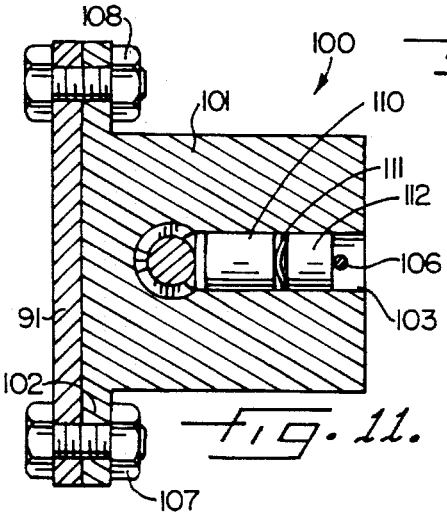
FIG. 11 is a top cross-sectional view of a drive shaft and a follower of a massaging apparatus according to the present invention taken along line 11—11 of FIG. 7.
Figure 14:
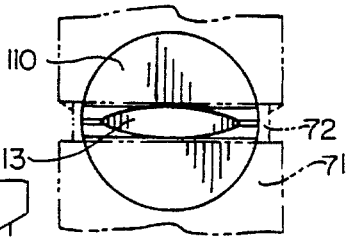
FIG. 14 is another fragmentary view of a follower engaging a drive shaft of a massaging apparatus according to the present invention with parts broken away for clarity.
Figure 15:
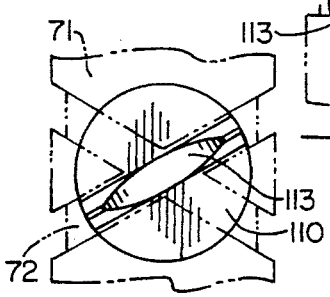
FIG. 15 is yet another fragmentary view of a follower engaging a drive shaft of a massaging apparatus according to the present invention with parts broken away for clarity.

FIGS. 7–15 further illustrate the operation of the elongate shaft 71 and the follower 110 of the massaging carriage 40. The shaft 71 is preferably a longitudinally extending double threaded shaft 71 (as best illustrated in FIGS. 3, 7, and 10). The first drive motor 81, preferably an electric motor, having a drive shaft extending therefrom connects to the shaft 71 for rotating the shaft 71 about its axis. A rectangular-shaped housing 101 connects to the massaging carriage 40 by bolts and nuts 107, 108 extended through and connected to the elongate plate member 91 and end plate member 102 of the housing 101. The housing 101 preferably has a first bore 105 longitudinally extending from an upper end of the housing 101 to a lower end of the housing 101 and through a medial portion thereof. The first bore 105 is adapted to receive a portion of the longitudinally extending shaft 71 therethrough as illustrated.

The shaft 71 and the housing 101 are interconnected so as to transport the massaging carriage 40 along the length of the shaft 71 upon rotation thereof. The shaft 71 preferably has an endless thread groove 72 extending along the length of the shaft 71. A follower 110 is adapted to mount within a second bore 105 of the housing 101 adjacent the first bore 105 and to slidably engage the groove 72 of the shaft 71. The second bore 103 is positioned within the housing 101 transverse to and interconnecting the first bore 105. The follower 110 preferably has an elongate cylindrical body portion 114 and a tongue 113 integrally connected to an end of the body portion 114. The second bore 103 receives the follower 110 therein so that the tongue 113 of the follower 110 slidably engages the groove 72 of the shaft 71 (as best shown in FIGS. 12–15). The positioning and the mounting of the shaft 71, housing 101, and follower 110 are such that as the shaft 71 rotates in only one direction R the massaging carriage 40 connected to the housing 101 reciprocally moves along the longitudinally extending direction of the shaft 71 (as best shown in FIGS. 4–6).

Figure 8:
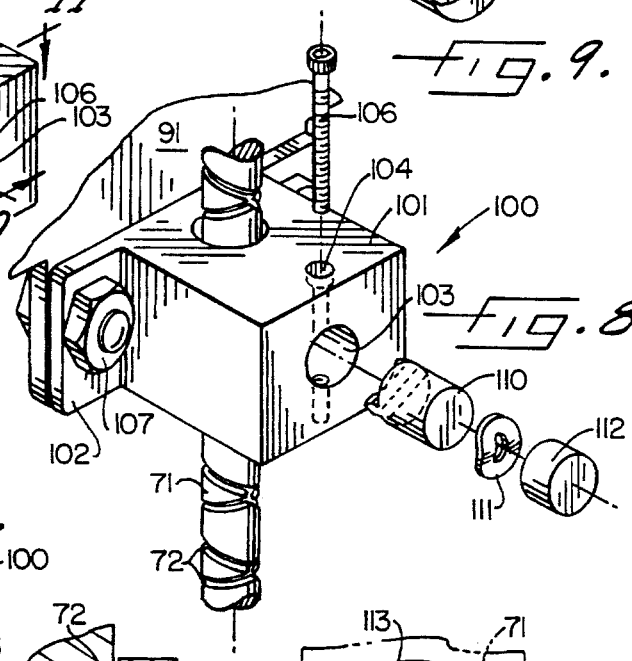
FIG. 8 is an enlarged fragmentary exploded view of a drive shaft and a follower of a massaging apparatus according to the present invention with parts broken away for clarity.

As best shown in FIG. 8, a resilient member 111 is also positioned within the second bore 103 of the housing 101 and longitudinally adjacent an end of the body portion 114 of the follower 110 opposite the tongue 113. A cylindrical-shaped follower extension member 112 is positioned within the second bore 103 and longitudinally adjacent the resilient member 111 so that the resilient member 111 and the follower extension member 112 allow the follower 110 to slidably rotate within the second bore 103 and thereby cooperate with the groove 72 of the shaft 71 as the massaging carriage 40 reciprocally moves along the shaft 71. A pin member 106 is secured to the housing 101 through an opening 104 therein and transversely extends across the second bore 103 adjacent the follower extension member 112. The pin member 106 secures the follower 110, the resilient member 111, and the follower extension member 112 within the second bore 103. This type of apparatus for driving the massaging carriage 40 provides a more continuous and controlled movement of the massaging carriage 40 as it reciprocally travels within the back 25 of the chair 20. The smooth and continuous motion of the follower 110 within the groove 72 also enables the user to easily control the positional location of the various massaging functions, i.e., kneading-type, back-pressure type, and vibration-type, of the massaging chair 20 according to the present invention.

In the drawings and specification, there have been disclosed typical illustrative embodiments of the present invention, and although specific terms are employed, they are used in a generic and descriptive sense only and not for purposes of limitation, the scope on the invention being set forth in the following claims.

That which is claimed is:

1. A massaging apparatus for providing an efficient and comfortable massage, the massaging apparatus comprising:

a massaging carriage;

first drive means connected to the carriage for reciprocating said carriage along a path of travel;

a first transverse rod rotatably mounted to said carriage;

at least one roller assembly mounted to said first transverse rod and including a plurality of separate rollers which are mounted for free rotation about parallel axes which are radially spaced from and parallel to said first transverse rod axis, said plurality of rollers adapted to contact a massage surface;

second drive means mounted to said carriage for rotating said first transverse rod about its axis so that said rollers sequentially rotate about the rod axis and thereby provide a cyclical action massage to the massage surface in contact with said rollers as said rollers rotate about said first transverse rod axis;

a second transverse rod mounted to said carriage generally parallel to said first transverse rod so that said second transverse rod reciprocally travels in a corresponding relationship to the reciprocal travel of said carriage, said second transverse rod having a plurality of rollers mounted thereto, to thereby provide a pressure type massage to the massage surface in contact with said plurality of rollers; and vibration means mounted to said carriage for vibration of said plurality of rollers during the reciprocal travel of said carriage.

2. The massaging apparatus as defined in claim 1, the first drive means further comprising a shaft adapted to mount to a support structure so as to extend along a substantial portion of the height dimension of said support structure, and means slidably interconnecting said shaft and said carriage so as to permit reciprocating movement of said carriage along the height dimension of said shaft.

3. The massaging apparatus as defined in claim 2, wherein said shaft is adapted to be centrally mounted along the transverse width of said support structure, and wherein one of said roller assemblies is positioned on each transverse side of said shaft.

4. The massaging apparatus as defined in claim 2, further comprising means for rotating said shaft about its axis, and thread means interconnecting said shaft and said carriage so as to transport said carriage along the length of said shaft upon rotation thereof.

5. The massaging apparatus as defined in claim 2, wherein said shaft rotating means continuously rotates said shaft in one direction, and wherein said thread means includes an endless thread groove extending along the length of said shaft, and a follower mounted to said carrier and engaging said groove so that said carriage reciprocates along said shaft upon such rotation of said shaft.

6. The massaging apparatus as defined in claim 1, wherein said carriage is adapted to be positionally supported in the height dimension of the support structure solely by said shaft.

7. A massaging apparatus for providing an efficient and comfortable massage, the massaging apparatus comprising:

a massaging carriage;

means mounting the massaging carriage for reciprocal movement along a path of travel;

first drive means for reciprocating said carriage along said path of travel;

a first transverse rod rotatably mounted to said carriage and so as to define a generally horizontal first transverse rod axis;

at least one roller assembly mounted to said rod and including a plurality of separate rollers which are mounted for free rotation about parallel axes which are radially spaced from and parallel to said rod axis, said plurality of rollers adapted to contact a massage surface;

second drive means mounted to said carriage for rotating said transverse rod about its axis while the carriage reciprocates along said path of travel and thereby provide a cyclical action massage to the massage surface in contact with said rollers as said rollers rotate about the rod axis;

a second transverse rod mounted to said carriage generally parallel to said first transverse rod so that said second transverse rod reciprocally travels in a corresponding relationship to the reciprocal travel of said carriage, said second transverse rod having a plurality of rollers mounted thereto, to thereby provide a pressure type massage to the massage surface in contact with said plurality of rollers; and vibration means mounted to said carriage for vibration of said plurality of rollers during the reciprocal travel of said carriage.

8. The massaging apparatus as defined in claim 7, wherein said mounting means includes a shaft mounted to a support structure so as to extend along a substantial portion of the height dimension of the support structure, and means slidably interconnecting said shaft and said carriage so as to permit reciprocating movement of said carriage along the height dimension of said shaft.

9. The massaging apparatus as defined in claim 8, wherein said first drive means comprises means for rotating said shaft about its axis, and thread means interconnecting said shaft and said carriage so as to transport said carriage along the length of said shaft upon rotation thereof.

10. The massaging apparatus as defined in claim 9, wherein said shaft rotating means continuously rotates said shaft in one direction, and wherein said thread means includes an endless thread groove extending along the length of said shaft, and a follower mounted to said carriage and engaging said groove.

11. The massaging apparatus as defined in claim 8, wherein said shaft is adapted to be centrally mounted along the transverse width of the support structure, and wherein one of said roller assemblies is positioned on each transverse side of said shaft.

12. The massaging apparatus as defined in claim 7, wherein said carriage is adapted to be supported in the height dimension of the support structure by said shaft.

13. The massaging apparatus as defined in claim 7, further comprising massaging carriage control means connected to the massaging apparatus and electrically communicating with said first and second drive means for separately controlling the operation thereof.

14. An apparatus for driving a massaging carriage positioned within the back of a massaging chair to thereby provide a more continuous and controlled movement of the massaging carriage, the apparatus comprising:

an elongate shaft adapted to be positioned within the back of the chair and longitudinally extending the substantial height of the back;

drive means connected to said shaft for rotating said shaft about its axis;

a housing adapted to mount to a massaging carriage and cooperating with said shaft, said housing having a bore longitudinally extending from an upper end of said housing to a lower end of said housing and through a medial portion thereof and being adapted to receive a portion of said longitudinally extending shaft therethrough; and thread means adapted for interconnecting said shaft and said housing so as to transport a massaging carriage along the length of said shaft upon rotation thereof, said thread means including an endless thread groove extending along the length of said shaft, and a follower adapted to mount to said housing adjacent said bore, said follower having an elongate cylindrical body portion and a tongue integrally connected to an end of said body portion, said tongue adapted to engage said groove.

15. The apparatus as defined in claim 14, wherein said shaft rotating means continuously rotates said shaft in only one direction so that a massaging carriage adapted to mount to said housing reciprocally moves along the longitudinally extending direction of said shaft.

16. An apparatus for driving a massaging carriage positioned within the back of a massaging chair to thereby provide a more continuous and controlled movement of the massaging carriage, the apparatus comprising:

an elongate shaft adapted to be positioned within the back of the chair and longitudinally extending the substantial height of the back;

drive means connected to said shaft for rotating said shaft about its axis;

a housing adapted to mount to a massaging carriage and cooperating with said shaft, said housing having a bore longitudinally extending from an upper end of said housing to a lower end of said housing and through a medial portion thereof and being adapted to receive a portion of said longitudinally extending shaft therethrough, and said housing having a second bore positioned transverse to and interconnecting said first bore;

thread means adapted for interconnecting said shaft and said housing so as to transport a massaging carriage along the length of said shaft upon rotation thereof, said thread means including an endless thread groove extending along the length of said shaft, and a follower adapted to be received within said second bore; and a resilient member positioned within said second bore of said housing and longitudinally adjacent an end of said body portion of said follower opposite said tongue end, and a cylindrical follower extension member positioned within said second bore and longitudinally adjacent said resilient member so that said resilient member and said follower extension member allow said follower to slidably rotate within said second bore and thereby cooperate with said groove of said shaft as a massaging carriage reciprocally moves along said shaft.

17. The apparatus as defined in claim 16, further comprising a pin member secured to said housing and transversely extending across said second bore adjacent said follower extension member to thereby secure said follower, said resilient member, and said follower extension member within said second bore.

18. The apparatus as defined in claim 15, wherein said drive means comprises an electric motor having a motor drive shaft connected to said elongate shaft.

* * * * *